US006396452B1

(12) United States Patent
Watts, Jr.

(10) Patent No.: US 6,396,452 B1
(45) Date of Patent: May 28, 2002

(54) SLOTTED CABLE ANTENNA STRUCTURE

(75) Inventor: Chester B. Watts, Jr., Annandale, VA (US)

(73) Assignee: Watts Antenna Co, Herndon, VA (US)

( * ) Notice: Subject to any disclaimer, the term of this patent is extended or adjusted under 35 U.S.C. 154(b) by 0 days.

(21) Appl. No.: 09/233,745

(22) Filed: Jan. 20, 1999

(51) Int. Cl.[7] ..... H01Q 13/10
(52) U.S. Cl. ..... 343/769; 343/771
(58) Field of Search ..... 343/769, 770, 343/771; 333/237; H01Q 13/10

(56) References Cited

U.S. PATENT DOCUMENTS 3,870,977 A * 3/1975 Peoples et al. ..... 343/771
4,464,665 A * 8/1984 Watts ..... 343/771

* cited by examiner

*Primary Examiner*—Michael C. Wimer

(57) ABSTRACT

This invention relates to improvements in slotted cable antenna structures. This slotted cable antenna is built on a length of standard semi-rigid rf transmission line having a number of slots (gaps) cut in its outer conductor. Associated with each slot is a shunt conductor, the length of which is adjusted to control the amount of rf energy which escapes through that slot. Between each slot, the semi-rigid line is bend into a meander (loop) to introduce controlled delay in the radiated rf energy from the following slot. The meander is by-passed with a solder connection to maintain continuity of antenna current with the chosen physical slot spacing, typically half-wavelength, approximately. An embodiment of this invention is useful as an element in frangible antenna arrays such as employed in UHF glide slope stations of the Instrument Landing System (ILS).

4 Claims, 1 Drawing Sheet

SLOTTED CABLE ANTENNA STRUCTURE

CROSS-REFERENCE TO RELATED APPLICATIONS

"Not applicable"

STATEMENT REGARDING FEDERALLY SPONSORED RESEARCH OR DEVELOPMENT

"Not applicable"

REFERENCE TO A MICROFICHE APPENDIX

"Not applicable"

BACKGROUND OF THE INVENTION

This invention relates to improvements in slotted cable antenna structures. It represents a simpler construction than that claimed in my earlier U.S. Pat. No. 4,464,665, Aug. 7, 1984, Watts, Jr., "Slotted Cable Antenna Structure," but it accomplishes a similar result. An embodiment of this invention is useful as an element in frangible antenna arrays such as may be employed in UHF glide slope ground stations of the Instrument Landing System (ILS).

BRIEF SUMMARY OF THE INVENTION

This slotted cable antenna is built on a length of standard semi-rigid rf transmission line having a number of slots (gaps) cut around the circumference of its outer conductor. Associated with each slot is a shunt conductor, the length of which is adjusted to control the amount of rf energy which escapes through that slot. Between each slot, the semi-rigid line is bend into a meander (loop) to introduce controlled delay in the radiated rf energy from the following slot. The meander is by-passed with a solder connection to maintain continuity of antenna current with the chosen physical slot spacing, typically half-wavelength, approximately.

DETAILED DESCRIPTION OF THE INVENTION

Figure 1:
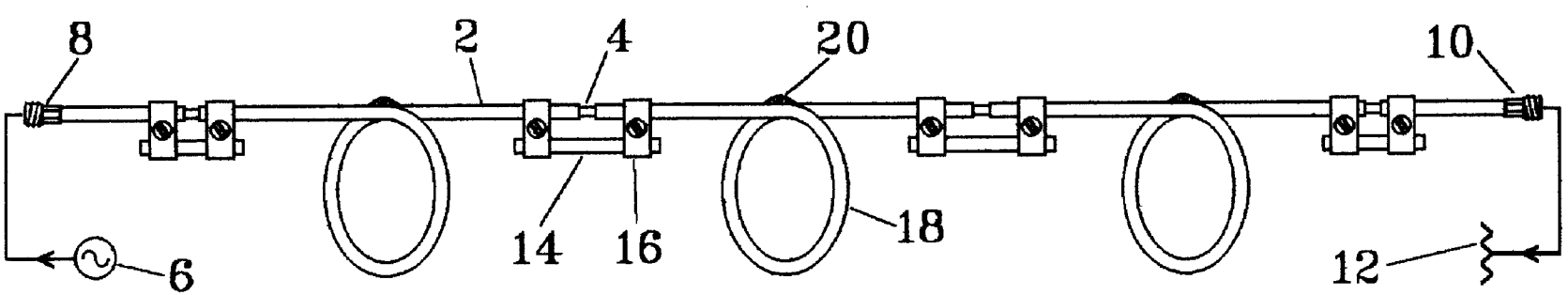
FIG. 1 shows an embodiment of the antenna structure, with associated feed circuit.

An overall view of the improved slotted cable antenna structure, FIG. 1, shows a length of standard semi-rigid transmission line 2, having a multiplicity of slots 4, cut in its outer conductor. Although FIG. 1 shows only four slots, a typical embodiment has twelve or more slots, spaced physically one half-wavelength, or so, apart.

Transmission line 2 contains, typically, a teflon dielectric insulation material which is visible at slot 4. Within the insulation, but not visible, is the copper inner conductor of the transmission line 2. A voltage source 6 feeds rf signal to transmission line 2 through the standard coaxial connector 8. That rf signal, which is not lost through radiation or dissipation, after traversing the length of transmission line 2, passes through coaxial connector 10 into resistive load 12.

A rod forming a conductive shunt 14, is connected across each slot 4 by means of clamps 16. The length of shunt 14 is used to control the amplitude of the rf signal escaping from that particular slot 4. A very short shunt 14 means that very little rf signal escapes through slot 4. The converse also is true. In a practical embodiment of the antenna, the slots near each end have progressively shorter shunt 14 in order to produce a tapered antenna current distribution and a radiation pattern having low side lobes.

Between each slot, the transmission line 2 is bent into a meander 18. The size of the meander 18 is used to control the phase of the rf energy escaping from the following slot 4, relative to that of the preceding slot, typically 360 degrees, more or less. However, the exterior of meander 18 is by-passed with solder connection 20 to maintain the antenna current continuity with the physical slot spacing, typically one half-wavelength, more or less. This procedure results in an antenna with a pattern of radiation mainly perpendicular to transmission line 2, with low side lobes.

I claim:

1. A slotted cable antenna structure comprising a length of semi-rigid coaxial transmission line, a multiplicity of slots cut in the outer conductor of said coaxial line, a shunt connected across each of said slots, a meander in said transmission line interposed between said slots, thereby introducing additional delay in any signals traveling inside said transmission line between said slots, conductive means by-passing said meander on the exterior of said outer conductor, thereby allowing antenna currents to flow on the exterior without being subject to said additional delay.

2. A structure as in claim 1 wherein said shunt comprises a conductive rod clamped across said slot, radiation from said slot controlled in amplitude by the length of said rod.

3. A structure as in claim 1 wherein said meander has a length calculated to delay the radiation from a slot relative to that from a preceding slot by substantially 360 electrical degrees.

4. A structure as in claim 1 wherein the exterior of said meander is conductively by-passed at a point such that the physical separation of two adjacent slots is substantially one half-wavelength.

* * * * *